United States Patent [19]

Lovy

[11] 4,219,141

[45] Aug. 26, 1980

[54] SUPPORTING FRAME FOR TRAFFIC CONES ON VEHICLES

[76] Inventor: Robert L. Lovy, 13509 Ann Louise, Houston, Tex. 77038

[21] Appl. No.: 923,783

[22] Filed: Jul. 12, 1978

[51] Int. Cl.[2] ..... B60R 7/00

[52] U.S. Cl. ..... 224/273; 280/762; 206/499; 116/28 R

[58] Field of Search ..... 224/42.03 R, 42.03 A, 224/42.1 R, 29 R, 32 R, 42.42 R, 42.46 R, 42.45 R; 206/500, 516, 499; 280/762; 116/28 R, 63 P, 63 C; 248/314, 311.1, 145.6, 145.9, 293, 201; 221/308, 309, 310; 296/37.1, 37.7

[56] References Cited

U.S. PATENT DOCUMENTS

| | | | |
|---|---|---|---|
| 1,412,128 | 4/1922 | Maurer | 248/311.1 |
| 1,568,834 | 1/1926 | Hauge et al. | 206/516 |
| 2,472,921 | 6/1949 | Quimper | 248/311.1 |
| 3,206,067 | 9/1965 | Smith, Jr. et al. | 221/310 |
| 3,788,268 | 1/1974 | Hiatt et al. | 116/28 R |
| 3,809,007 | 5/1974 | Brown | 116/63 P |
| 3,942,752 | 3/1976 | Shaw | 248/311.1 |

FOREIGN PATENT DOCUMENTS

| | | | |
|---|---|---|---|
| 237251 | 1/1962 | Australia | 208/500 |

*Primary Examiner*—Kenneth W. Noland
*Attorney, Agent, or Firm*—Neal J. Mosely

[57] ABSTRACT

A supporting frame for use on motor vehicles for supporting highway traffic markers of the type having a flat square base and an elongated brightly colored cone extending vertically therefrom (commonly called traffic cones). The supporting frame is characterized by its ability to be installed on the vehicle in almost any position, e.g., horizontally or vertically. The frame comprises rectangular box-shaped framework having an interior shape fitting the periphery of the square bases of the traffic cones. The frame is open at one end for insertion and removal of traffic cones and has two open sides facilitating removal of said traffic cones. The supporting frame has a ring spaced from the base portion thereof and supported on supporting rods. The ring supports the cone portions of the traffic cones and also provides a point of attachment for the supporting frame to the structural member of the vehicle.

10 Claims, 6 Drawing Figures

SUPPORTING FRAME FOR TRAFFIC CONES ON VEHICLES

BACKGROUND OF THE INVENTION

1. Field of the Invention

This invention relates to new and improved supporting frames for use on motor vehicles such as highway service trucks, telephone service trucks, utility trucks, ets. for supporting traffic markers of the type known as traffic cones.

2. Brief Description of the Prior Art

Traffic markers, called traffic cones, are well known and have been in use for many years. Traffic cones usually have a flat square base and an elongated cone extending vertically therefrom. The vertically extending cone is usually of brightly colored fluorescent material.

Traffic cones have been carried in the past on service vehicles, such as utility trucks, telephone trucks, etc., loosely stacked in the back of the vehicle. There has been some need for a suitable support for carrying traffic cones in a stacked relation.

Hiatt et al. U.S. Pat. No. 3,788,268 discloses conical supports carried on pivotted arms for supporting traffic cones on the side of service vehicles. This arrangement has the disadvantage of causing the traffic cones to be carried at a substantial distance from the side of the vehicle. Also, the arrangement is practical only for traffic cones which do not have a separate base portion.

Evans et al. U.S. Pat. No. 959,489 discloses a center support for hollow objects having a central opening, such as lampshades.

Box-shaped structures are also known for carrying and feeding conical products, such as drinking cups.

SUMMARY OF THE INVENTION

Motor vehicles, such as utility trucks, telephone trucks, etc., are provided with a novel supporting frame for traffic cones. The supporting frame is characterized by the fact that it can be supported on a structured member of the vehicle in either vertical or horizontal position. The supporting frame is a box-shaped frame, preferably formed of angle irons. The interior shape of the frame fits the periphery of the square bases of the traffic cones when positioned therein. The box-shaped frame is open at one end for insertion and removal of traffic cones and has two open sides which facilitate removal of the traffic cones. At the end of the frame opposite the open end there is provided a supporting member, preferably a supporting ring supported on four rods extending from the end of the frame to receive and support the ends of the traffic cones.

DESCRIPTION OF THE PREFERRED EMBODIMENT

Highway and utility and telephone construction and maintenance vehicles are often required to be parked along or in busy highways and streets. This creates a hazard for traffic and also is hazardous to the vehicle and its working crew. It is common practice to carry traffic cones on such vehicles which are placed in the street or road to direct traffic around the working area. In the past, traffic cones have been carried separately or stacked in the service trucks or other vehicles. There have also been frames of various types made to support such cones but supporting devices known in the art have not been of the type that can be installed in a variety of positions.

Figure 1:
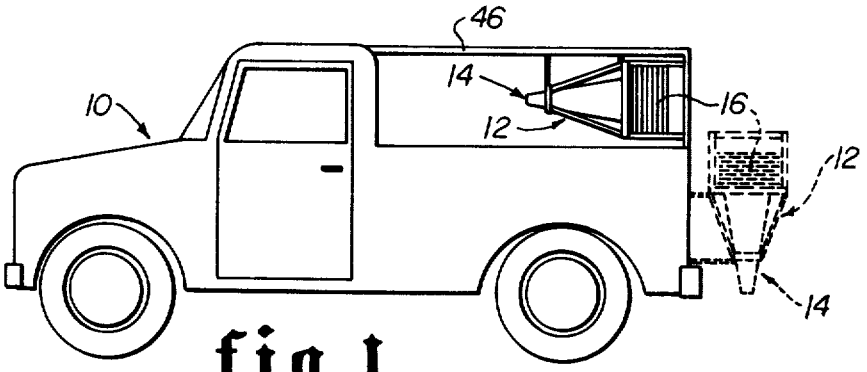
FIG. 1 is a view in side elevation of a highway or utility service truck, or the like, illustrating the positioning of the supporting frame for traffic cones thereon.

In the drawings, and more particularly in FIG. 1, there is shown a service vehicle 10 having a supporting frame 12 for traffic cones 14 supported in a horizontal position in full line and shown supported in a vertical position in dotted line.

Figure 6:
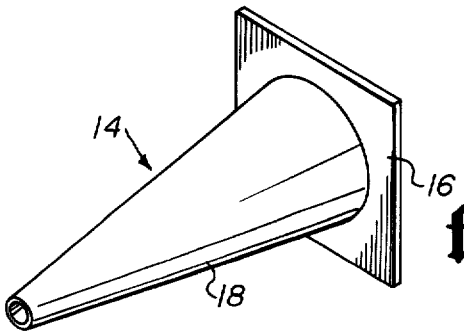
FIG. 6 is an isometric view of a traffic cone of the type supported in the supporting frame shown in FIGS. 2–5 above.

In FIG. 6, the traffic cone 14 is shown in an enlarged isometric view. The traffic cone has a flat, square base 16 and a cone portion 18 which extends vertically therefrom when supported on the base 16. The traffic cone is preferably molded of rubber or plastic which is flexible and will not break easily if struck by a moving vehicle. The conical portion 18 of traffic cone 16 is usually of a brightly colored yellow or orange fluorescent material.

Traffic cones 14 are hollow and may be carried in a stacked position.

Figure 3:
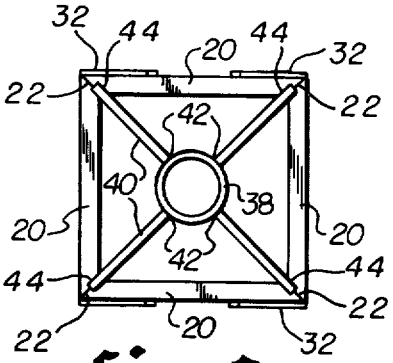
FIG. 3 is a left end elevation of the frame shown in FIG. 2.

Supporting frame 12 is rectangular box-shaped frame having an interior shape fitting the periphery of the square base 16 of traffic cones 14. Supporting frame 12 is preferably formed of four angle irons 20 which are joined together by welding at four corners 22, as seen in FIG. 3. Four angle irons 24 are welded to the corners 22 of the square base portion formed by angle irons 20 as indicated at 26 in FIG. 2. The interior of angle irons 24 define the interior shape of the box-shaped frame which receives the square base portion 16 of traffic cones 18.

Figure 2:
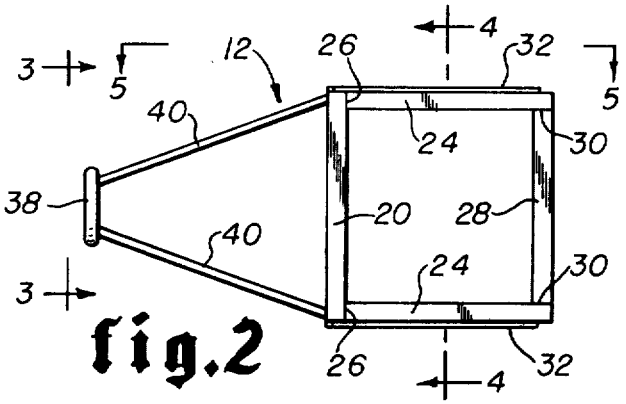
FIG. 2 is a view in side elevation of the supporting frame for traffic cones.
Figure 4:
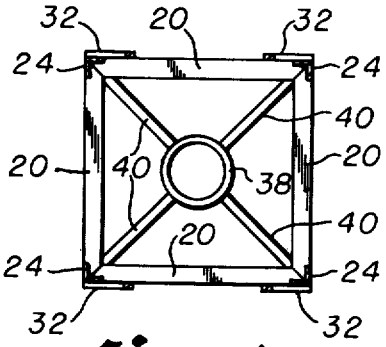
FIG. 4 is a sectional view taken on the line 4—4 of FIG. 2.
Figure 5:
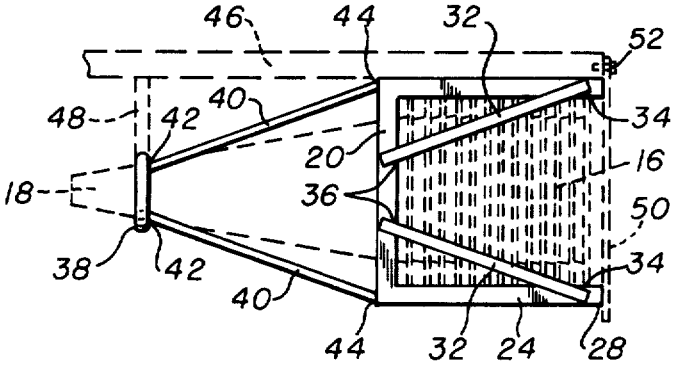
FIG. 5 is a view of the upper side of the frame shown in FIG. 2, with the frame turned and supported on a structural portion of the service vehicle (shown in dotted line).

Angle irons 24 extend to the right of the base portion formed by angle irons 20, as seen in FIG. 2, and have their distal ends connected by laterally extending braces 28 which are welded thereon as indicated at 30. The braces 28 are positioned preferably to the outside of the ends of angle irons 24 so that they will not interfere with the insertion of the traffic cones into the supporting frame. The braces 28 connect the angle irons 24 in pairs, there being only two parallel braces 28. The other side of the frame is seen in FIG. 5. Diagonally extending braces 32 are welded as at 34 to the distal ends of angle irons 24 and are welded at 36 to angle irons 20. Braces 32 provide lateral support for angle irons 24 which are not connected by braces 28. This structure provides open sides for the box-shaped frame which facilitates insertion and removal of traffic cones 14.

The box-shaped frame is provided with a supporting means extending from the end of the frame opposite the open end through which the traffic cones are inserted and which provides a support for the ends of traffic cones 14. This supporting means comprises a ring member 38 which is supported on the base of the frame formed by angle irons 20 by four rod members 40. Rod members 40 are welded to ring member 38 as shown at 42 and are welded to the corners 22 of the base as indicated at 44. Ring member 38 is shown as a circular ring, but obviously could be of any suitable shape so long as it provides the desired function of supporting the ends of the traffic cones and providing a point of attachment to the vehicle.

In FIGS. 1 and 5 the supporting frame for traffic cones is shown supported in a horizontal position. In FIG. 5 the supporting frame is shown as being supported on a horizontally extending member 46 of the vehicle. It may be welded or bolted or otherwise supported on such member. A vertically extending rod support 48 is shown as the supporting connection between member 46 and supporting ring 38. Also, at the end of supporting member 46 there may be provided a bar-shaped member 50 which is pivotted as at 52 thereon and which provides a stop preventing the traffic cones from coming out of the supporting frame inadvertently. Member 50 may be pivotted out of the way when the traffic cones are inserted or removed from the supporting frame.

The supporting frame has a shape and configuration which will receive the square bases 16 of traffic cones 14. The traffic cones have their conical end portions 18 extending through the supporting means or ring 38. The supporting frame is characterized by its ease of installation and the fact that it can be installed in either a horizontal or vertical position. In FIG. 1 the horizontal installation is shown in full line and the vertical installation is shown in dotted line. This supporting frame has the advantage that it may be carried at any desired point on the vehicle or, in some cases, under the vehicle to provide a place for storage of the traffic cones 14.

While this invention has been described fully and completely with special emphasis upon a single preferred embodiment, it should be understood that within the scope of the appended claims the invention may be practiced otherwise than as specifically described herein.

I claim:

1. A supporting frame for use on motor vehicles for supporting highway traffic markers of the type having a flat, square base and an elongated brightly colored cone extending vertically therefrom, said frame being adapted to be attached to a structural member of a vehicle and comprising a rectangular box-shaped frame having an interior shape fitting about the periphery of and supporting at a square base of said box-shaped frame, the corners of the square bases of said traffic markers in a fixed position when positioned therein, said box-shaped frame being open at one end and spaced from said square base of the box-shaped frame for insertion and removal of said traffic markers and said box-shaped frame having two open sides between said square base and said one open end to facilitate removal of said traffic markers, and supporting means secured on the square base of said frame opposite said one open end thereof and extending outwardly therefrom to receive and support the cone portions of said highway traffic markers.

2. A traffic marker supporting frame according to claim 1 in which said box-shaped frame comprises four angle irons secured together at their ends to form said square base, four angle irons secured one on each corner of said square base and extending normal to the plane of said base to form the edges of said frame defining the interior shape fitting the periphery of said traffic markers, braces secured to and connecting the distal ends of said last named angle irons in pairs leaving said open sides therebetween, and braces extending from said last named angle irons to said base to secure said last named angle irons against lateral deflection.

3. A traffic marker supporting frame according to claim 1 in which said supporting means comprises a ring-shaped member positioned away from an opposite end of said frame by a distance less than the length of the cone portion of said traffic markers, and means supporting said ring-shaped member on said square base of said frame to support the cone portions of said traffic markers.

4. A traffic marker supporting frame according to claim 3 in which said ring-shaped member supporting means comprises a plurality of supporting rods secured to said opposite end of said frame at one end of said supporting rods and to said ring-shaped member at the other end of said supporting rods.

5. A traffic marker supporting frame according to claim 1 comprising four angle irons secured together at their ends to form said square base, four angle irons secured one on each corner of said base and extending normal to the plane of said base to form the edges of said box-shaped frame and the interior of said angle irons defining the shape fitting the periphery of said traffic markers, braces secured to and connecting the distal ends of said last named angle irons in pairs leaving said open sides therebetween, braces extending from said last named angle irons to said base to secure said last named angle irons against lateral deflection, a ring-shaped member positioned on the side of said base opposite said last named angle irons by a distance less than the length of said cone portions of said traffic markers, and means supporting said ring-shaped member on said base.

6. A traffic marker supporting frame according to claim 1 comprising four angle irons secured together at their ends to form said square base, four angle irons secured one on each corner of said base and extending normal to the plane of said base to form the edges of said box-shaped frame and the interior of said angle irons defining the shape fitting the periphery of said traffic markers, braces secured to and connecting the distal ends of said last named angle irons in pairs leaving said open sides therebetween, braces extending from said last named angle irons to said base to secure said last named angle irons against lateral deflection, a ring-shaped member positioned on the side of said base opposite said last named angle irons by a distance less than the length of said cone portions of said traffic markers, and a plurality of supporting rods, each having one end secured to said base and the other end secured to said ring-shaped member.

7. A traffic marker supporting frame according to claim 6 supported on a motor vehicle in a horizontal position.

8. A traffic marker supporting frame according to claim 6 supported on a motor vehicle with said cone portion supporting ring member inclined downwardly.

9. A traffic marker supporting frame according to claim 1 supported on a motor vehicle in a horizontal position.

10. A traffic marker supporting frame according to claim 1 supported on a motor vehicle with said cone portion supporting means inclined downwardly.

* * * * *